US007646362B2

(12) United States Patent
Mizukoshi et al.

(10) Patent No.: US 7,646,362 B2
(45) Date of Patent: Jan. 12, 2010

(54) CONTROLLING CURRENT IN DISPLAY DEVICE

(75) Inventors: Seiichi Mizukoshi, Kanagawa (JP); Nobuyuki Mori, Sakae-cho (JP); Kouichi Onomura, Yokohama (JP); Makoto Kohno, Tsuzuki-ku (JP)

(73) Assignee: Eastman Kodak Company, Rochester, NY (US)

( * ) Notice: Subject to any disclaimer, the term of this patent is extended or adjusted under 35 U.S.C. 154(b) by 640 days.

(21) Appl. No.: 10/812,546

(22) Filed: Mar. 29, 2004

(65) Prior Publication Data

US 2004/0201582 A1 Oct. 14, 2004

(30) Foreign Application Priority Data

Apr. 8, 2003 (JP) ..... 2003-103640

(51) Int. Cl.
*G09G 3/32* (2006.01)

(52) U.S. Cl. ..... 345/76; 345/204; 345/77; 345/82; 348/790; 349/72

(58) Field of Classification Search ..... 345/102, 345/76, 432, 207, 74, 204; 348/790; 349/67, 349/72

See application file for complete search history.

(56) References Cited

U.S. PATENT DOCUMENTS 4,489,349 A * 12/1984 Okada ..... 348/674
4,799,106 A * 1/1989 Moore et al. ..... 348/619
5,157,525 A * 10/1992 Eaton et al. ..... 345/87
5,166,795 A * 11/1992 Lee et al. ..... 348/687
5,216,504 A * 6/1993 Webb et al. ..... 348/190
5,345,277 A * 9/1994 Blankevoort et al. ..... 348/679
5,760,843 A * 6/1998 Morimura et al. ..... 348/678
6,078,302 A * 6/2000 Suzuki ..... 345/77
6,271,813 B1 * 8/2001 Palalau ..... 345/77
6,456,016 B1 * 9/2002 Sundahl et al. ..... 315/291
6,542,138 B1 * 4/2003 Shannon et al. ..... 345/76
6,583,775 B1 * 6/2003 Sekiya et al. ..... 345/76
6,806,852 B2 * 10/2004 Ishizuka et al. ..... 345/77
6,870,522 B2 * 3/2005 Sagano et al. ..... 345/75.2
6,897,937 B2 * 5/2005 Choi ..... 349/187
6,952,193 B2 * 10/2005 Abe et al. ..... 345/87
7,064,733 B2 * 6/2006 Cok et al. ..... 345/76
7,093,941 B2 * 8/2006 Kawashima et al. ..... 353/97
7,161,566 B2 * 1/2007 Cok et al. ..... 345/76
7,184,065 B2 * 2/2007 Shin ..... 345/690

(Continued)

FOREIGN PATENT DOCUMENTS

JP 07-322179 12/1995

(Continued)

*Primary Examiner*—Sumati Lefkowitz
*Assistant Examiner*—Grant D Sitta
(74) *Attorney, Agent, or Firm*—Raymond L. Owens

(57) ABSTRACT

A display device, for carrying out image display on a display panel by controlling current flowing in display elements for each pixel based on image data, including display setting circuitry for setting a relationship between image data and current values for current flowing in display elements in response to an input adjustment signal, to set contrast or brightness; estimation circuitry for estimating panel current flowing in all pixels when carrying out display for the display panel based on the image data; and current control circuitry for controlling actual panel current by correcting the set contrast or brightness based on the panel current estimated by the estimation circuitry.

3 Claims, 6 Drawing Sheets

U.S. PATENT DOCUMENTS

2001/0035850 A1* 11/2001 Okamoto et al. ..... 345/77
2002/0030647 A1* 3/2002 Hack et al. ..... 345/82
2002/0101395 A1* 8/2002 Inukai ..... 345/83
2002/0105279 A1* 8/2002 Kimura ..... 315/169.3
2003/0122759 A1* 7/2003 Abe et al. ..... 345/89
2004/0021671 A1* 2/2004 Leyvi ..... 345/589
2005/0179639 A1* 8/2005 Hsieh ..... 345/102

FOREIGN PATENT DOCUMENTS

JP 2002-116732 4/2002

* cited by examiner

CONTROLLING CURRENT IN DISPLAY DEVICE

FIELD OF THE INVENTION

The present invention relates to adjusting contrast and brightness of a display device.

BACKGROUND OF THE INVENTION

One example of a pixel circuit for an active type OLED display device is shown in FIG. 1. The source of a p-channel TFT1 for pixel drive is connected to a power supply PVdd, while the drain is connected to an anode 3 of an OLED (organic EL) element. Also, the cathode of the OLED element is connected to a low voltage power supply CV.

The gate of the TFT1 is connected to an auxiliary capacitor power supply Vcs via an auxiliary capacitor C, as well as to a data line Data for supplying a voltage based on pixel data (luminance data) via an n-channel TFT2 for selection. The gate of the TFT2 is connected to a gate line Gate extending in a horizontal direction.

At the time of display, the gate line is made H, and the TFT2 of a corresponding line is turned on. In this state pixel data is supplied to the data line Data, and this charges the auxiliary capacitor C. The TFT1 is then driven by a voltage in response to the pixel data, and the current through the TFT1 flows in the OLED element 3.

Here, the amount of emitted light and the current in the OLED element 3 has a substantially proportional relationship, but current begins to flow in the TFT1 when a voltage difference from the gate−PVdd exceeds a specified threshold voltage Vth. Pixel data supplied to the data line Data is added to the voltage (Vth) so that drain current starts to flow in the vicinity of image black level. Also, the amplitude of an image signal is such that there is specified luminance in the vicinity of a white level.

FIG. 2 is one example of a relationship between input voltage (Vgs), and luminance and current icv of the OLED element 3. In this manner, the OLED element 3 begins to emit light at voltage Vth, and is set such that emitted light becomes a white level at a white level input voltage Vw.

Here, since the luminance of light emitted from the OLED element 3 is proportional to the current flowing in the element, as described above, in order to drive a panel it is necessary to have a power supply capable of providing the current required when carrying out display for an image having maximum luminance over the entire surface. Accordingly, a power supply is required that has considerable surplus capacity compared to the power supply capacity required under normal usage conditions.

On the other hand, with a display device for displaying mainly natural images, used in a digital camera or video camera, the average level of image data is normally about 25%, and the maximum current of the power supply is rarely utilized.

There have also been proposed methods of calculating a histogram and average luminance in image frame units and generating panel drive data based on the results, with the intention of improving image quality and conserving power (see Japanese Patent Laid-open No. Hei. 7-322179 and Japanese Patent Laid-open No. 2002-116732.

With a display device having contrast and brightness adjustment built-in, it is necessary to determine the capacity of the power supply section assuming adjustment to the respective maximum values. There is a problem that the capacity of the power supply has to be significantly increased.

SUMMARY OF THE INVENTION

It is an object of this invention to provide contrast and brightness adjustment in a display device which doesn't require a substantial increase in the capacity of the power supply.

This object is achieved by a display device for carrying out image display on a display panel by controlling current flowing in display elements for each pixel based on image data, comprising:

display setting circuitry for setting a relationship between image data and current values for current flowing in display elements in response to an input adjustment signal, to set contrast or brightness;

estimation circuitry for estimating panel current flowing in all pixels when carrying out display for the display panel based on the image data; and current control means for controlling actual panel current by correcting the set contrast or brightness based on the panel current estimated by the estimation means.

In this way, according to the present invention the set contrast or brightness is corrected based on estimated panel current. The panel current can be controlled to specified values or less.

Also, if the panel current estimated by the estimation means does not exceed a specified set value, correction of contrast or brightness by the current control means is preferably not carried out.

Further, if the panel current estimated by the estimation means exceeds the specified set value, the current control means preferably corrects the contrast or brightness such that actual panel current at the time the estimated panel current becomes maximum panel current coincides with the maximum panel current.

In this way, if the estimated panel current is small, the present invention controls actual panel current to less than the maximum panel current.

The current control means can store a coefficient defining the relationship between estimated panel current required in correction of contrast or brightness, and correction of contrast or brightness, and corrects the contrast or brightness using this coefficient.

Actual current consumption is detected at the factory, and if an optimum value for this coefficient is inspected and stored, then even if there are variations in efficiency for each panel, variations in maximum consumed current can be suppressed for each display device.

BRIEF DESCRIPTION OF THE DRAWINGS

FIG. 4(*b*) is a drawing showing a relationship between panel current I and maximum luminance;

FIG. 6(*b*) is a drawing showing a relationship between panel current I and maximum luminance.

DESCRIPTION OF THE PREFERRED EMBODIMENTS

When contrast or brightness have been raised, rise in contrast or brightness at regions where panel current is large is suppressed, so that maximum current flowing in the panel does not exceed a set value.

Figure 3:
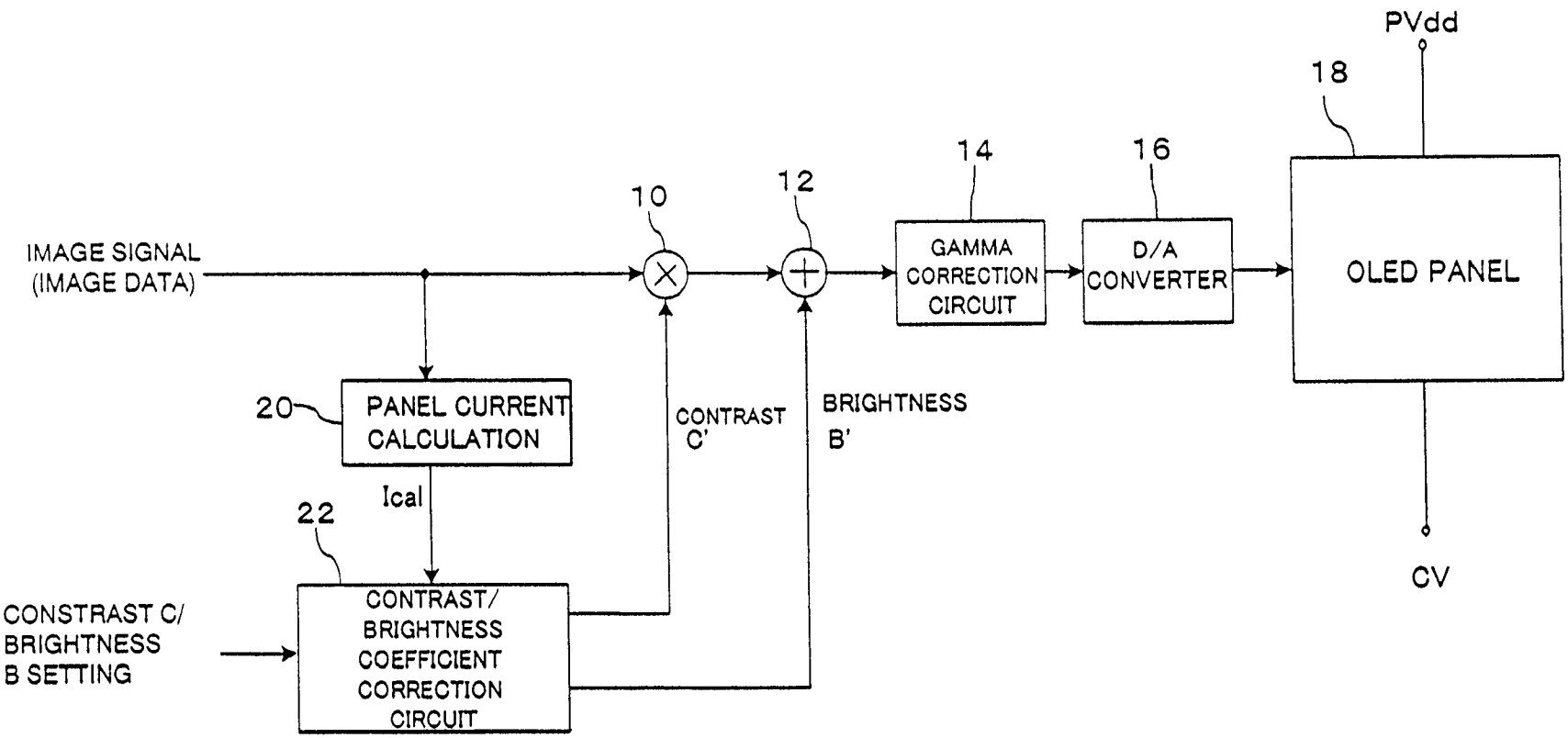
FIG. 3 is a drawing showing the structure of an embodiment.

FIG. 3 is a block diagram showing the structure of an embodiment. An image signal is input from the outside. This image signal has three separate luminance signals, for each of RGB, for example, and is digital data. The image signal is input to a multiplier 10, where it is multiplied by a contrast C' to adjust the contrast. The output from the multiplier 10 is input to an adder 12, where it is added to a brightness B'. The output of the adder 12 is input to a gamma correction circuit 14, and after gamma correction has been performed, this output is converted to an analog signal by the D/A converter 16 and supplied to an OLED panel 18. The gamma correction circuit 14 carries out correction so that a relationship between the input data from the gamma correction circuit 14 and the current of the OLED panel 18 becomes linear.

Figure 1:
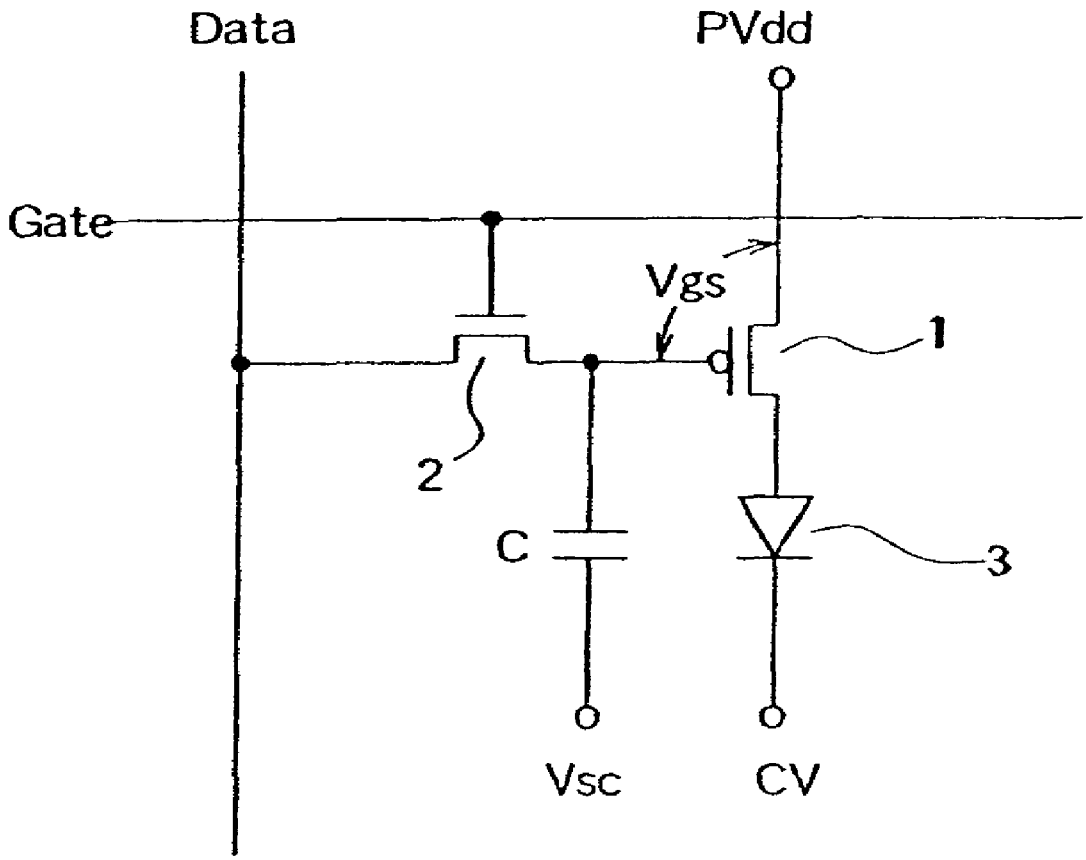
FIG. 1 (Prior Art)
FIG. 1 is a drawing showing the structure of a pixel circuit.
Figure 2:
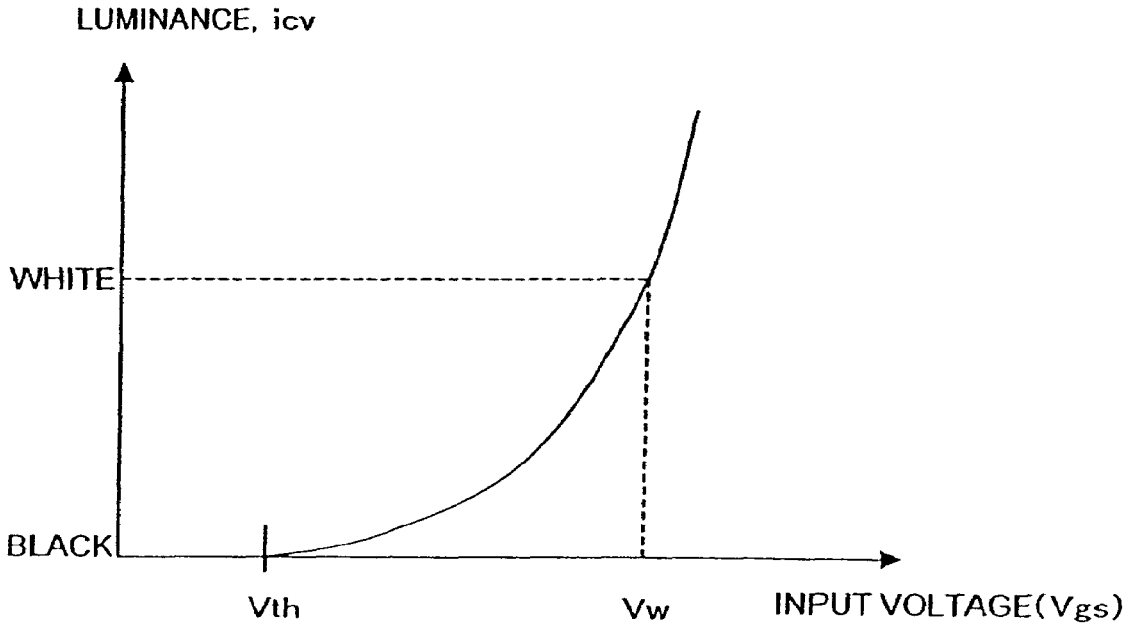
FIG. 2 (Prior Art)
FIG. 2 is a drawing showing a relationship between input voltage and luminance.

The OLED panel 18 is made up of the pixel circuits shown in FIG. 1 arranged in a matrix configuration. Gate lines Gate in the horizontal direction, data lines Data in the vertical direction and Power supply lines connected to a power supply PVdd are then arranged. The gate lines Gate and data line Data are also controlled by vertical and horizontal drive circuits provided at the periphery of a display region where pixel circuits are arranged, so as to supply image data for every pixel obtained from an image signal to each pixel.

With this embodiment, the image signal is supplied to a panel current calculating block 20. This panel current calculating block 20 obtains panel current Ical, being the sum total of current flowing in all pixels of the OLED panel 18, from data for a single frame of a plurality of frames of an image for driving the OLED panel 18. As the panel current Ical, instead of the sum total for one frame it is also possible to use an average value for one frame or a sum total or average value for a plurality of frames.

The panel current Ical acquired in the panel current calculating block 20 is then supplied to a contrast/brightness coefficient correction circuit 22. This contrast/brightness coefficient correction circuit 22 corrects set values for contrast (C) and brightness (B) input by a user based on panel current Ical calculated from the image signal, supplies a corrected contrast coefficient C' to the multiplier 10 and supplies a corrected brightness coefficient B' to the adder 12. As a result, the image signal supplied to the gamma correction circuit 14 has been subjected to contrast and brightness adjustment using the corrected contrast coefficient C' and brightness coefficient B'.

A description will now be given for the contrast coefficient C' and the brightness coefficient B'.

With an active matrix type OLED panel 18, data for each pixel is held for the duration of one frame by a capacitor (auxiliary capacitor) added to the gate of a TFT for normal pixel drive. As a result, when current flowing in a pixel has a proportional relationship with respect to image data, the total current of the pixel section of the OLED panel 18 at a particular point in time is proportional to the total image data for one frame that has been input from that point until one frame before. By measuring this proportional constant in advance, it is possible to calculate total current (panel current Ical) of pixel section in a frame unit from the image data.

Here, the calculated panel current Ical is a value calculated with contrast C and brightness B set to C=1 and B=0.

In FIG. 3, if the relationship between input data values of the D/A converter 14 and the panel current is linear, then when C'=1 and B'=0, the relationship between panel current (Ical) flowing in all pixels of the OLED panel 18 and the total pixel data for one frame (Drame) is obtained using the following equation.

$$Ical = D\text{frame}/(k \cdot E)$$

Here, k is gamma correction input data divided by luminance, and E is luminance divided by current flowing in one pixel.

Figure 4:
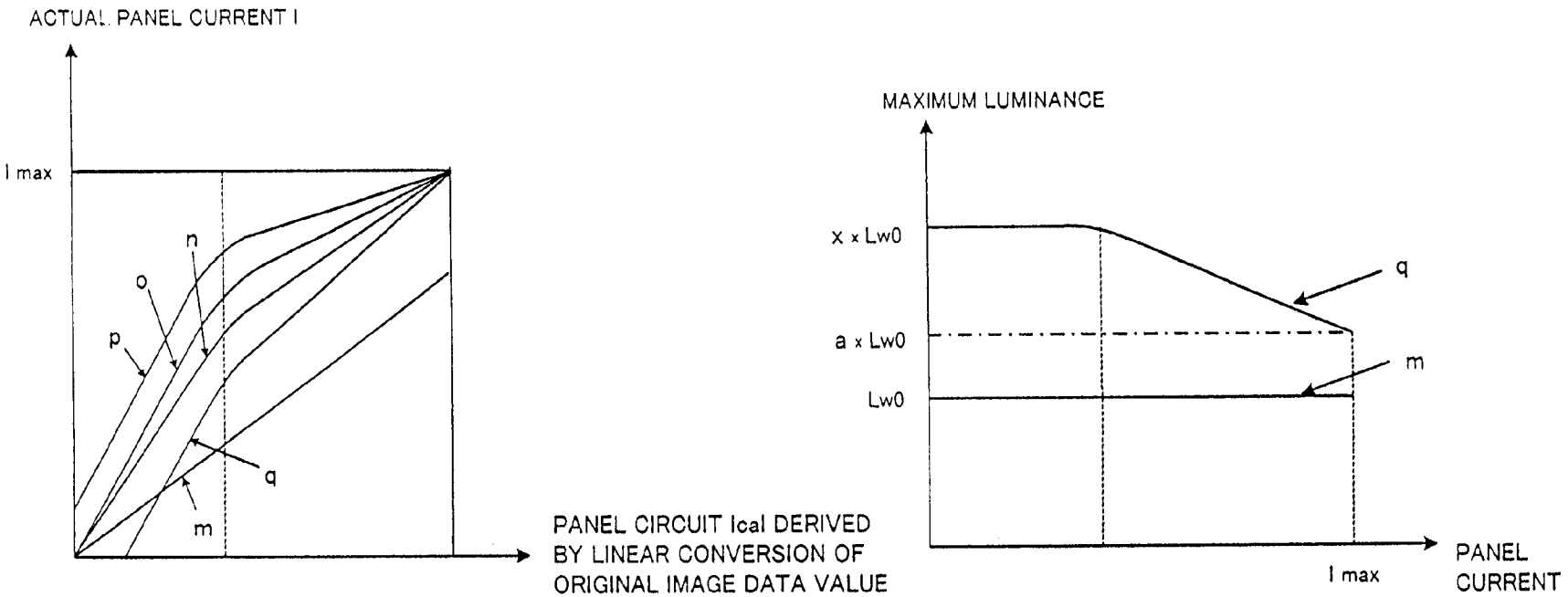
FIG. 4(*a*) is a drawing showing a relationship between panel current Ical obtained through calculation and actual panel current I.

The relationship between panel current (Ical) obtained in this way and the actual panel current (I) is shown in FIG. 4(*a*), and the relationship between total panel current at this time and maximum luminance of an image displayed is shown in FIG. 4(*b*). In these drawings, each graph is an example for when values are set as follows: m, C−1, B−0 (initial setting: n, C>1, B=0; o, C>1, B=0; p, C>1, B>0; q, C>1, B<0.)

In this way, if C=1 and B=0, for initial setting, then as shown by the straight line m, panel current I actually flowing increases linearly in response to panel current Ical calculated in response to image data. Also, with characteristics n and o, B=0, and passes through the origin, but since the value of C is larger for the case of o, the gradient is large. Also, with characteristics p and q, the entire characteristic is shifted because of the value of B.

Also, as shown in FIG. 4(*b*), from the point where panel current I becomes a specified value or more, a limit is imposed on the maximum luminance of a pixel. Accordingly, contrast C' becomes smaller, and as shown in FIG. 4(*a*), the rate of increase in actual panel current I is reduced compared to the panel current Ical acquired through calculation.

Natural images taken with a digital camera or video camera have an average pixel level that is less than 50%, except in special cases, because of effects such as automatic exposure. As a result, for images having an average level that is a particular value or more, that is, images having a power consumption value of a particular value or more, even if the rate of increase in contrast adjustment is reduced, there is no effect for a lot of images.

Figure 5:
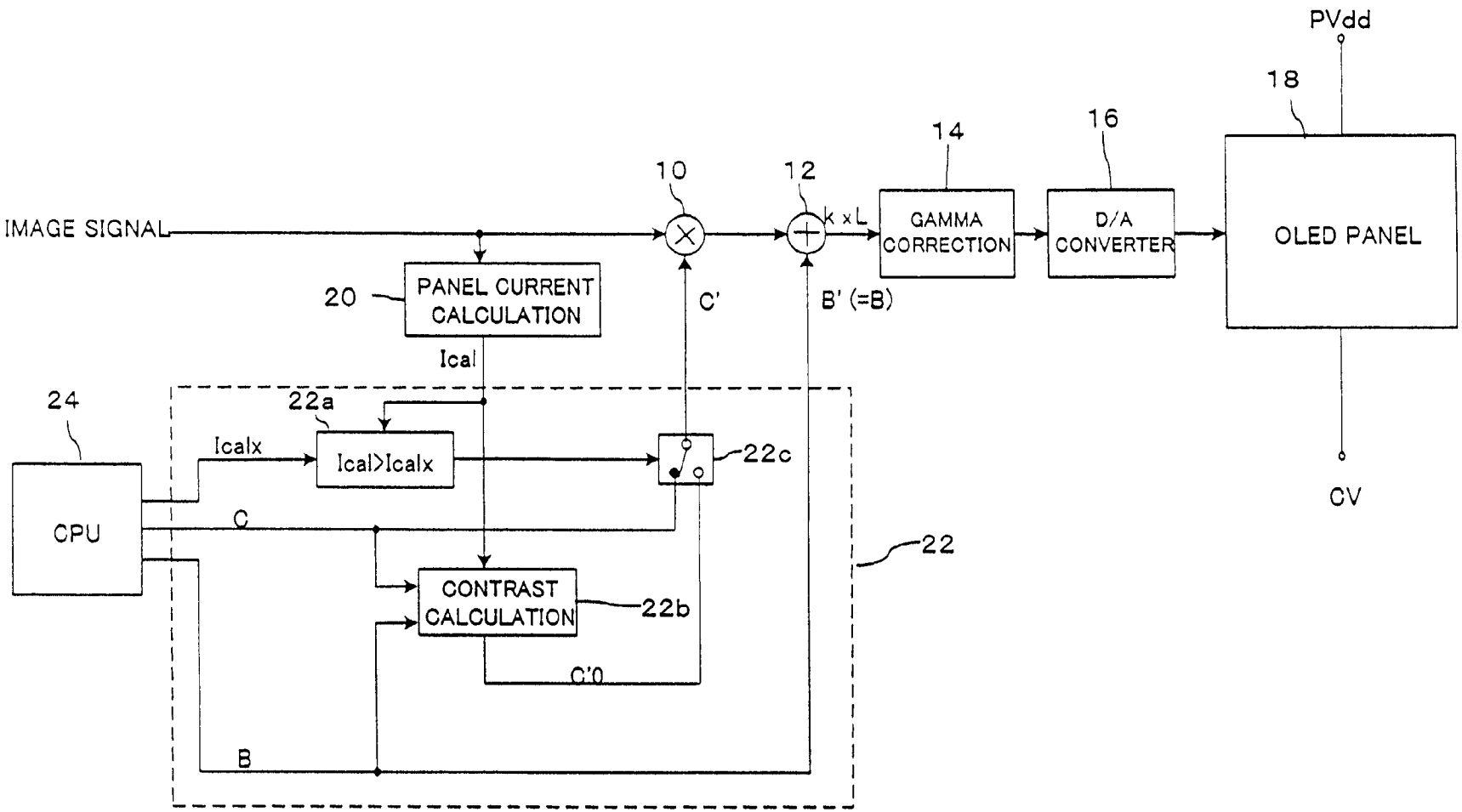
FIG. 5 is a drawing showing the structure of a contrast/brightness correction circuit.

FIG. 5 shows the structure of the contrast/brightness coefficient correction circuit 22. The contrast/brightness coefficient correction circuit 22 is made up of an Ical>Icalx determination section 22*a*, a contrast calculation section 22*b*, and a switch 22*c*. Also, the contrast value C and the brightness value B are supplied from a CPU 24 for controlling various operations. Panel current Ical from the panel current calculating block 20, that has been calculated from the image signal, is compared with Icalx in the Ical>Icalx determination section. Ical is also supplied to the contrast calculation section 22*b* together with contrast C and brightness B, and corrected contrast C'0 is calculated. Contrast C and corrected contrast C'0 are input to the switch 22*c*, and using the result from the Ical>Icalx determination section 22*a*, when Ical≦Icalx C is selected, while C'0 is selected when Ical>Icalx.

In this way, with the panel current less than a predetermined specified value Icalx, input contrast C and brightness B are supplied as they are to the multiplier 10 and adder 12 in the contrast/brightness coefficient correction circuit 22. As a result, display is carried out at the set luminance.

On the other hand, when Ical>Icalx, C'0 is selected, contrast is corrected and display is carried about using the corrected contrast. That is, contrast C' has a small value compared to C, and actual panel current I is suppressed. As a result, in this case, maximum luminance of the display pixels is suppressed.

Specifically, if the number of pixels for one frame is N, when the panel current resulting from calculation Ical≦Icalx, the actual panel current I is:

$$I=(C\cdot D\text{frame}+B'\cdot N)'(k\cdot E)$$

and if Ical>Icalx, the actual panel current I is:

$$I=(C'0\cdot D\text{frame}+B'\cdot N)/(k\cdot E)$$

In the example of FIG. 5, B'=B.

A description will now be given of the calculation of corrected contrast C'0 in the contrast/brightness coefficient correction circuit 22. Calculation is carried out in the contrast/brightness coefficient correction circuit 22 using the following equation.

$$C'0=C-(C+B/(k\cdot Lw0)-a)\cdot(Ical-Icalx)/(I\text{max}-Icalx) \quad (1)$$

Here, C is contrast setting value, B is brightness setting value, Lw0 is maximum luminance at initial setting time (C=1, B=0), a is luminance when panel current displaying all white becomes Imax divided by Lw0, Ical is panel current derived from linear conversion of original image data, Imax is maximum current flowing in the panel, Icalx is a value for Ical at the point where maximum luminance begins to decrease, and can be arbitrarily set, and k is gamma correction input data divided by luminance.

Figure 6:
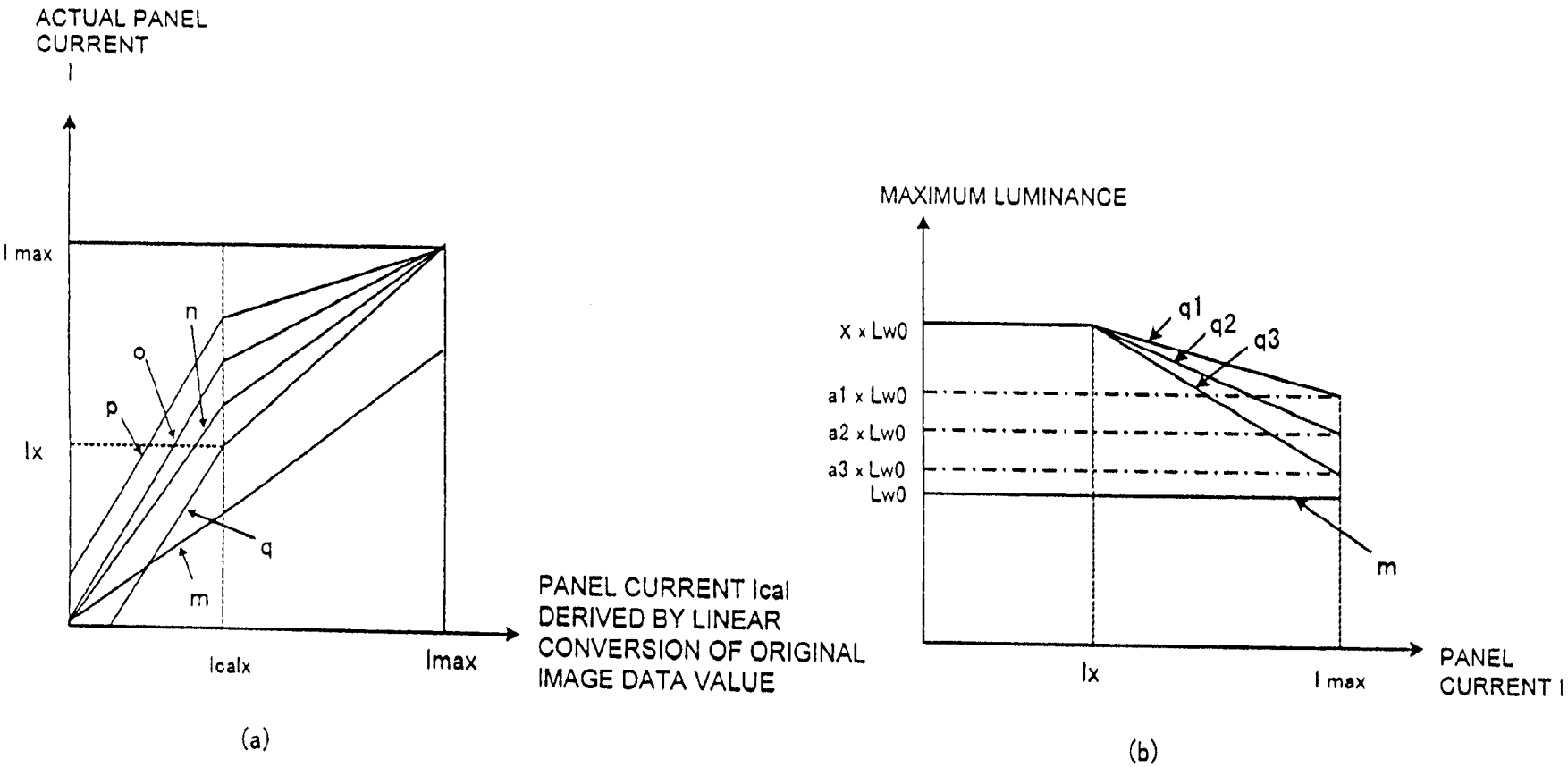
FIG. 6(*a*) is a drawing showing a relationship between panel current Ical obtained through calculation and actual panel current I.

As shown in FIG. 6(*a*), panel current I is shifted by the brightness B. Also, when the panel current obtained through calculation Ical=Icalx, Ical−Icalx=0, C'=C and contrast C' at the point in time where suppression of panel current I commences coincides with the contrast C as it is. In the case of characteristic m, C=1, B=0, a=1, and C'=C=1, and no correction is carried out.

Also, in the case where it is assumed that B=0, if Icalx is exceeded, (C−a) is divided and subtracted from contrast C until Imax is reached, for Ical=Imax, C'0=a becomes true, and the panel current I actually flowing at this time also becomes I=Imax. With respect to brightness B also, from when calculated panel current Ical=Icalx until Ical=Imax, when division is carried out and Ical=Imax becomes true, actual panel current becomes I=Imax.

In this way, the relationship between panel current Ical derived from linear conversion of original image data values and actual panel current I becomes as shown in FIG. 6(*a*). For example, if C, B and Icalx have been set so that the Ical−I characteristic of characteristic q is held, a maximum luminance characteristic for panel current as shown in FIG. 6(*b*) is obtained. If panel current I exceeds current Ix corresponding to Icalx, the maximum luminance falls in accordance with coefficient a.

Here, the rate of decrease of maximum luminance differs depending on light emission efficiency, such as q1, q2 and q3, and becomes a=a1, a=a2 and a=a3. Specifically, even if there are variations in light emission efficiency for each panel, the maximum consumed current of the panel does not vary, and it is possible to make the maximum luminance in a range where average luminance is low the same. Accordingly, even if there are variations in panel efficiency it is possible to suppress variations in maximum consumed current of every set by adjusting a at the time of shipping.

Here, besides values for a, values such as Lw0 and Icalx required in the calculation of C'0 are stored in a non-volatile memory provided inside the device, such as inside the contrast/brightness coefficient correction circuit 22, at the factory. As a result, the above described calculation becomes possible at the time of use. Values such as Er, Eg and Eb required for the calculation of I are also similarly stored in non-volatile memory. With respect to k, it is possible to use a value that has been stored in the gamma correction circuit 14. It is also possible to have a configuration where values are obtained using automatic calculation based on current when some or all of these set values are used or measured luminance values.

The maximum luminance when panel current is small is determined using set values of contrast and brightness, and the luminance at this time becomes x·Lw0.

Also, when contrast and brightness have been set so that 100% luminance becomes less than or equal to a·Lw0, maximum luminance is constant regardless of the current value.

Icalx can be set arbitrarily, but is preferably set so that when C and B have been set to maximum values, actual panel current Ix at that time is less than or equal to Imax.

In the case of a panel for displaying colors by driving RGB pixels with separate signal sources, since light emission efficiencies Er, Eg and Eb for each of RGB generally vary for each color, the total current I of the OLED panel 18 is calculated using the following equation.

$$I=R\text{frame}/Er+\text{frame}/Eg+B\text{frame}/Eb \quad (2)$$

Here, Rframe is the total of R image data for one frame, Gframe is the total of G image data for one frame, Bframe is the total of B image data for one frame, Er is R luminance divided by current flowing in one R pixel, Eg is G luminance divided by current flowing in one G pixel, and Eb is B luminance divided by current flowing in one B pixel.

In this way, according to this embodiment, total current for one frame of the OLED panel 18 is estimated based on input image data, and estimate total panel current Ical reaches a predetermined value Icalx, and the set value C is used as it is without carrying out correction of contrast C.

On the other hand, if panel total current Ical exceeds a specified value, correction is added to the contrast C, and corrected contrast value C' is varied in accordance with the magnitude of panel total current Ical so that panel current I actually flowing at the time total current Ical from calculation becomes permitted maximum current Imax, and control is carried out so that actual panel current I does not exceed Imax.

Specifically, panel current is made to not exceed a predetermined value, and it is possible to vary contrast and brightness by suppressing reduction in image quality to a minimum.

With the embodiment described above, no correction has been carried out for brightness B supplied to the adder 12, and brightness was taken into consideration at the time of correcting contrast C. However, it is also possible to have direct correction of B. For example, during the period from when Ical=Icalx to Ical=Imax, B is continuously divided so as to become zero, and the term for B can then be deleted from the calculation of contrast C. Specifically, the term (C+B/(k·Lw0)) in equation (1) above can also be included in conversion of B' from B. It is also possible to use contrast C as it is and to include this correction in conversion from B to B'.

As has been described above, according to the present invention, set contrast and brightness are corrected based on estimated panel current. In this way, it is possible to suppress panel current to a specified value or less.

The invention has been described in detail with particular reference to certain preferred embodiments thereof, but it will be understood that variations and modifications can be effected within the spirit and scope of the invention.

PARTS LIST

1 p-channel TFT1
2 n-channel TFT2
3 anode
10 multiplier
12 adder
14 gamma correction circuit
16 D/A converter
18 OLED panel
20 calculating block
22 correction circuit
22*a* Ical>Icalx determination section
22*b* contrast calculation section
22*c* switch
24 CPU

The invention claimed is:

1. A display device, comprising:

an active-matrix OLED display panel for receiving image data, the panel having a plurality of pixels, each pixel having an OLED element;

means for supplying setting values for contrast and brightness, wherein such setting values are separate from the image data to the OLED display panel;

the active-matrix OLED display panel including display setting circuitry including a multiplier and an adder for setting a relationship between image data and current values for current flowing in all OLED elements in response to the supplied contrast and brightness setting values and the supplied image data;

estimation circuitry for estimating total panel current flowing in all of the plurality of pixels when carrying out display for the display panel based on the image data; and current control circuitry for controlling actual panel current by correcting the supplied contrast or brightness setting values based on the panel current estimated by the estimation circuitry, so that the actual panel current does not exceed a selected maximum value; and wherein the current control circuitry controls contrast based on the following equation:

$$C'=C-(C+B/(k\cdot Lw0)-a)\cdot(Ical-Icalx)/(\mathrm{Imax}-Icalx),$$

where C is contrast setting value, B is brightness setting value Lw0 is maximum luminance at initial setting time (C=1, B=0), a is luminance at the time panel current becomes IMax, when displaying a totally white surface, divided by Lwo, Ical is panel current when subjecting original image data values to linear conversion, Imax is maximum current flowing in the panel, Icalx is the Ical value (can be arbitrarily set) for the point at which maximum luminance beams to lower, and k is gamma correction input data divided by luminance.

2. The display device of claim 1, wherein the estimation means estimates total current based on the sum or average of image data for a single image frame or a plurality of image frames.

3. A display device, comprising:

an active-matrix OLED display panel for receiving image data, the panel having a plurality of pixels, each pixel having an OLED element;

means for supplying setting values for contrast and brightness, wherein such setting values are separate from the image data to the OLED display panel;

the active-matrix OLED display panel including display setting circuitry including a multiplier and an adder for setting a relationship between image data and current values for current flowing in all OLED elements in response to the supplied contrast and brightness setting values and the supplied image data;

estimation circuitry for estimating total panel current flowing in all of the plurality of pixels when carrying out display for the display panel based on the image data; and current control circuitry for controlling actual panel current by correcting the supplied contrast or brightness setting values based on the panel current estimated by the estimation circuitry, so that the actual panel current does not exceed a selected maximum value; and wherein the estimation circuitry estimates panel current based on the following equation:

$$I=R\mathrm{frame}/Er+G\mathrm{frame}/Eg+B\mathrm{frame}/Eb,$$

where, Rframe is the sum total of R pixel data for one frame, Gframe is the sum total of G pixel data for one frame, Bframe is the sum total of B pixel data for one frame, Er is R luminance divided by current flowing in one R pixel, Eg is G luminance divided by current flowing in one G pixel, and Eb is B luminance divided by current flowing in one B pixel, wherein R, G, and B respectively means to Red, Green and Blue.

* * * * *